US005116239A

United States Patent [19]

Siwinski

[11] Patent Number: 5,116,239

[45] Date of Patent: May 26, 1992

[54] MULTICONDUCTOR FLAT CABLE CONNECTOR, APPARATUS AND METHOD

[75] Inventor: Paul P. Siwinski, Seminole, Fla.

[73] Assignee: AMP Incorporated, Harrisburg, Pa.

[21] Appl. No.: 538,284

[22] Filed: Jun. 14, 1990

[51] Int. Cl.[5] ..... H01R 9/07

[52] U.S. Cl. ..... 439/497; 439/496

[58] Field of Search ..... 439/492–499, 439/353–355, 356, 357, 92, 680, 681, 607, 79, 609, 716, 248, 540, 290, 291, 295

[56] References Cited

U.S. PATENT DOCUMENTS

| | | | |
|---|---|---|---|
| 3,394,337 | 7/1968 | Miller | 439/680 |
| 3,573,719 | 9/1968 | Lightner | 339/196 |
| 3,601,768 | 1/1969 | Lightner | 339/103 M |
| 3,649,498 | 10/1972 | Hardesty et al. | 439/248 |
| 4,008,941 | 2/1972 | Smith | 439/499 |
| 4,090,764 | 5/1978 | Malsby et al. | 439/716 |
| 4,094,566 | 2/1977 | Dola et al. | 339/14 R |
| 4,181,384 | 2/1978 | Dola et al. | 339/14 R |
| 4,354,719 | 9/1980 | Weidler | 339/59 M |
| 4,367,909 | 10/1980 | Shatto, Jr. et al. | 339/176 MF |
| 4,408,823 | 10/1983 | Huber | 439/497 |
| 4,601,527 | 1/1985 | Lemke | 339/14 R |
| 4,616,893 | 3/1984 | Feldman | 339/14 R |
| 4,621,885 | 11/1986 | Szcresny et al. | 439/357 |
| 4,655,518 | 4/1987 | Johnson et al. | 439/609 |
| 4,747,787 | 3/1987 | Siwinski | 439/108 |
| 4,756,696 | 7/1988 | Whiteman, Jr. | 439/79 |
| 4,824,384 | 4/1989 | Nicholas et al. | 439/496 |
| 4,860,447 | 3/1988 | Nicholas et al. | 29/863 |
| 4,875,881 | 10/1989 | Caveny et al. | 439/540 |
| 4,915,650 | 4/1990 | Daly et al. | 439/492 |
| 4,948,379 | 8/1990 | Evans | 439/493 |
| 4,973,264 | 11/1990 | Kamono et al. | 439/498 |
| 4,975,081 | 12/1990 | Daly et al. | 439/498 |
| 4,993,969 | 2/1991 | Cabourne | 439/498 |

FOREIGN PATENT DOCUMENTS

| | | | |
|---|---|---|---|
| 0274609 | 7/1988 | European Pat. Off. | 439/492 |
| 49-6543 | 2/1974 | Japan . | |

*Primary Examiner*—Larry I. Schwartz
*Assistant Examiner*—Hien D. Vu

[57] ABSTRACT

An electrical connector for coupling the wires of a plurality of multiconductor flat cables with another electrical connector comprising, in combination a pluarlity of electrically insulating blocks; a plurality of signal contacts extending through each block, the signal contacts of each block adapted to receive the wires of one associated multiconductor flat cable; and a housing for supporting the plurality of blocks in a fixed position with respect to each other, the housing having means to releasably couple with another electrical connector. Also disclosed is the method of fabricating the electrical connector.

17 Claims, 7 Drawing Sheets

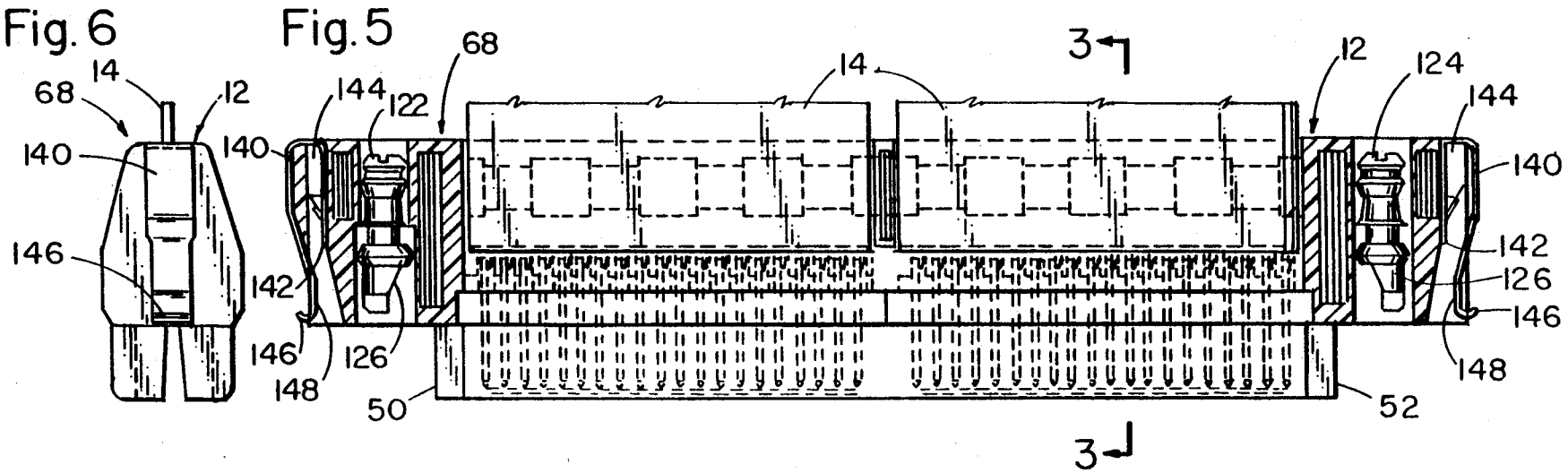
Fig. 5
Fig. 6
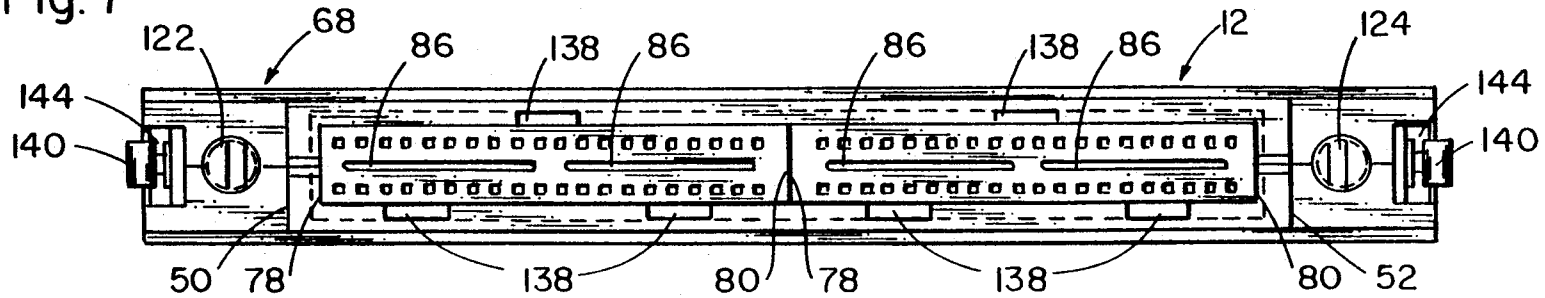
Fig. 7

MULTICONDUCTOR FLAT CABLE CONNECTOR, APPARATUS AND METHOD

BACKGROUND OF THE INVENTION

1. Field of the Invention

This invention relates to a multiconductor flat cable connector and, more particularly, to a connector for coupling electrically conductive wires of a plurality of multiconductor flat cables to traces of a printed circuit board and to a method of fabricating such connector.

2. Description of the Background Art

The development of new electrical cables in which a large number of wires are encapsulated in a flat insulating web has produced significant advantages in computers, telecommunication devices, and the electronic industry generally. These cables are manufactured with conductors formed as fine parallel wires located on closely spaced centerlines. They may be used for transmitting electrical power or, in the alternative, electrical signals.

Along with the obvious advantages of size reduction and ease of handling the flat cables per se, such flat cables also present certain disadvantages, both mechanically and electrically. From the mechanical standpoint, the fineness of the wires and the closeness of their spacing generally increase wire handling difficulties during the coupling of the individual wires to other electrical components such as connectors. Further, since their centerline spacings are unusually small, they may not necessarily coincide with the standard centerline spacings for commonly used electrical elements. This creates interconnection problems. The development of even smaller cables with finer, more closely spaced wires, and the need for greater numbers of wires for each connector further aggravate these mechanical problems in addition to complicating the design of connectors compatible with such further miniaturized cables.

From the electrical standpoint, particularly when flat cables are used for signal transmission purposes, the closeness of wire centerlines dictates their positioning at a specific, precise, constant distance for a particular application if the accurate transmission of signals is to be accomplished. Of equal importance, when flat, multi-wire cables are terminated with connectors, such connectors must be designed for controlling the characteristic impedance of the transmitted signals while matching it to the cable as well as the electronic devices being coupled.

In past connectors, such connector devices were normally limited to 40 connections. With the advance of technology, however, customers now need connectors with greater than 40 connections. Connections numbering in excess of 100 are needed and the future is almost limitless as to the number of connections that may be utilized.

The present invention is directed to modifying known devices such as those described in U.S. Pat. No. 4,747,787, assigned to the assignee of the present invention, whereby connectors may properly position a plurality of multiconductor flat cables with great numbers of pins. The only limitation appears to be in the number of electrical cables that can be fabricated by manufacturers of the multiconductor flat cables. The industry standard is in large part due to the manufacturing capabilities of such manufacturers. The present invention is directed to coupling a plurality of multiconductor flat cables, whether of 20 or 40 wires, into a common connector to facilitate the needs of the industry.

From a structural standpoint, the key features of the present invention include mechanisms on the connector for precluding improper connection to an associated connector to thereby eliminate the possibility of improper polarization. Another feature is that forces will be applied within the connector, not only vertically or axially between the cover halves and the pin support blocks, but also horizontally to provide lateral forces which allow for the properly positioned ultrasonic welding of the support blocks to the housing halves. Another feature is the use of attachment mechanisms at the ends of the connector for retaining the connector in position on the printed circuit board. In the past, such attachment mechanisms were along the lengths of the connector, undesirably increasing the amount of area on the printed circuit board required for the coupling. An additional advantage is in the fabrication technique wherein large numbers of pins of a plurality of cables may be coupled in a high quality environment for effecting high performance characteristics with regard to impedance control, cross talk abatement, etc.

The prior art discloses many types of other connectors for coupling multiconductor flat cables to a mating connector and electronic device. Note, for example, U.S. Pat. Nos. 3,573,719 and 3,601,768 to Lightner; 4,094,566 and 4,181,384 to Dola et al.; 4,354,719 to Weidler; 4,367,909 to Shatto et al.; 4,601,527 to Lemke and 4,860,447 to Nichols et al. None, however, discloses a connector or fabrication method of use having sufficient utility for its convenient use with a plurality of multiconductor flat cables formed with conductive wires of 0.0085 inches in diameter, several times smaller than those previously employed, cables with wires of a diameter as contemplated by the present invention. Such significantly reduced wire diameter allows for the proportionate reduction in the spacing between centerlines to 0.0125 inches along with a proportionate increase in the number of wires per cable to 81 wires per linear inch. While U.S. Pat. No. 4,616,893 discloses a connector with controlled characteristic impedance between printed circuit boards, there is no prior art teaching or suggestion of releasable connectors for a plurality of flat, multi-wire, signal transmission cables with controlled impedance characteristics matching the cable, the mating connector and the electronic devices to be coupled.

It is difficult to provide for an economical termination of a large number of conductors on the precise center lines required for this connector in such a manner that the appropriate impedance and other electrical characteristics will be maintained in the connector. By using a modular configuration in which a single size module is repetitively used, significant manufacturing efficiencies can be realized. One particular problem is the difficulty in maintaining appropriate space for a large plurality of conductors and contacts positioned end to end. This problem arises because of the build up of manufacturing tolerances. This problem is not alleviated in the prior art or by separating the individual components of the assembly into modular elements, since stacking tolerances are still a problem. In a modular configuration, it still remains important to position these individual modular subassemblies within a housing in such a manner that the electrical characteristics necessary for a high speed interconnection system, such as can be achieved with this invention can be maintained. The instant invention provides a means for fabricating such an assembly.

None of these background art patents teaches or suggests the accurate, efficient, convenient, and economical connector and fabrication method as described herein. Known methods and connectors are simply lacking in one regard or another.

As illustrated by the great number of prior patents, efforts are continuously being made in an attempt to more efficiently connect electrical elements of ever decreasing size. None of these prior art efforts, however, suggests the present inventive combination of method steps and component elements arranged and configured for coupling electrical elements as disclosed and claimed herein. Prior methods and connectors do not provide the benefits attendant with the connector and method of the present invention. The present invention achieves its purposes, objectives and advantages over the prior art methods and devices through a new, useful and unobvious combination of method steps and component elements, through the use of a minimum number of functioning parts, at a reduction in cost to manufacture and operate, and through the utilization of only readily available materials and conventional components.

It is, therefore, an object of the present invention to provide an electrical connector for coupling the wires of a plurality of multiconductor flat cables with another electrical connector comprising, in combination a plurality of electrically insulating blocks; a plurality of signal contacts extending through each block, the signal contacts of each block adapted to receive the wires of one associated multiconductor flat cable; and a housing for supporting the plurality of blocks in a fixed position with respect to each other, the housing having means to releasably couple with another electrical connector.

It is a further object of the present invention to couple the wires of a plurality of multiconductor flat cables to a printed circuit board through a single connector.

It is a further object of the present invention to minimize the usage of printed circuit board space in the coupling of a connector thereto.

It is a further object of the present invention to preclude the possibility of improperly coupling connectors with respect to each other.

It is a further object of the present invention to properly position and orient components of a connector prior to their joining as by ultrasonic welding.

Lastly, it is a further object of the present invention to manufacture a connector capable of coupling a plurality of cable multiconductor flat cables to a printed circuit board.

These objects and advantages should be construed as merely illustrative of some of the more prominent features and applications of the present invention. Many other beneficial results can be attained by applying the disclosed invention in a different manner or by modifying the invention within the scope of the disclosure. Accordingly, other objects and advantages as well as a fuller understanding of the invention may be had by referring to the summary and detailed description of the preferred embodiment of the invention in addition to the scope of the invention as defined by the claims taken in conjunction with the accompanying drawings.

SUMMARY OF THE INVENTION

The present invention is defined by the appended claims with the specific preferred embodiments shown in the attached drawings. For the purposes of summarizing the invention, the invention may be incorporated into an electrical connector for coupling the wires of a plurality of multiconductor flat cables with another electrical connector comprising, in combination a plurality of electrically insulating blocks; a plurality of signal contacts extending through each block, the signal contacts of each block adapted to receive the wires of one associated multiconductor flat cable; and a housing for supporting the plurality of blocks in a fixed position with respect to each other, the housing having means to releasably couple with another electrical connector.

The last mentioned means includes clips releasably secured to the ends of the housing. The clips are S-shaped with first ends receivable in recesses of the housing. The electrical connector further includes orienting means at the ends of the housing adapted to mate with another electrical connector to insure proper orientation when coupling the electrical connector with the other electrical connector. The orienting means is formed as pairs of posts, the one post of each pair having a surface angled with respect to an angled surface of the other post of its pair. The housing is formed of mating housing halves with recesses for receiving the plurality of blocks. The blocks are formed with projections for being received within the recesses to insure rough lateral positioning of the blocks within the housing halves. The recesses and projections are different on opposite sides of the connector to preclude improper positioning and movement between the blocks and housing halves. The electrical connector further includes ledges formed in the housing halves to receive the blocks and preclude improper positioning and movement between the blocks and housing halves. The blocks and housing halves are coupled together through ultrasonic welding.

The invention may also be incorporated into a combination for conducting electrical current to the traces of a printed circuit board comprising a first connector having a plurality of electrically insulating blocks, a plurality of signal contacts extending through each block, and a housing for supporting the plurality of blocks in a fixed position with respect to each other; a plurality of multiconductor flat cables, each multiconductor flat cable being operatively associated with one of the blocks, each multiconductor flat cable having a plurality of signal wires for conducting current with each signal wire having a stripped free end in electrical contact with one signal contact of its associated block; and a second connector couplable to a printed circuit board, the second connector having receptacle connectors for receiving the signal contacts of the first connector to thereby electrically couple the signal wires of the multiconductor flat cable with the receptacle connectors.

The receptacle connectors are electrically connected to traces of a printed circuit board. The receptacle connectors include elongated tails for extending through holes in a printed circuit board. The receptacle connectors and their tails include a right angle bend. The combination further includes a flat shield with apertures receiving the tails of each receptacle connector and positioned in contact with the second connector. The combination further includes an elongated ground bus extending through each block and an elongated receptacle connector in the second connector for receiving the ground bus.

The invention may be incorporated into a method of joining together a plurality of blocks and housing halves to form an electrical connector comprising the steps of holding a plurality of blocks in parallel relationship with respect to each other: holding housing halves in parallel relationship with respect to each other on opposite sides of the plurality of blocks; moving the housing halves into contact with the plurality of blocks; supporting the blocks and housing halves in proper position with respect to each other through ledges in the housing halves and projections and recesses in the blocks and housing halves; and sonicly welding together the blocks and housing halves.

Lastly, the present invention may be incorporated into a method a assembling an electrical connector for interconnecting a plurality of multiconductor flat cables having signal and ground conductors configured to maintain a prescribed impedance in each cable to a second electrical connector without altering the prescribed impedance, the method comprising the step of positioning a plurality of modular subassemblies, each having a plurality of terminals in an insulative block, to a fixturing member, the fixturing member comprising means for precisely positioning the modular subassemblies relative to each other by engaging at least one of the terminals in each modular subassembly and precisely positioning the engaged terminals relative to each other; securing an insulative cover means to all of the modular subassemblies by bonding each block to the insulative cover means while at least one terminal is held in the fixturing member.

The terminals in each modular subassembly includes a ground bus precisely positioned with respect to the other terminals in the modular subassembly, the fixturing block engaging the ground bus to precisely position each of the terminals in all of the modular subassemblies relative to each other. The blocks are ultrasonically bonded to the cover means. The cover comprises two mating covers, the blocks being ultrasonically bonded to the covers and the covers being ultrasonically bonded to each other.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art that the conception and the specific embodiments disclosed herein may be readily utilized as a basis for modifying or designing other methods and apparatus for carrying out the same purposes of the present invention. It should also be realized by those skilled in the art that such equivalent methods and apparatus do not depart from the spirit and scope of the present invention as set forth in the appended claims.

BRIEF DESCRIPTION OF THE DRAWINGS

For a more complete understanding of the nature objects and advantages of the present invention, reference should be had to the following detailed description taken in conjunction with the accompanying drawings in which:

FIG. 5 is a front elevational view of the connector shown in FIG. 2.

FIG. 6 is a end elevational view of the connector shown in FIG. 5.

FIG. 7 is a bottom view of the connector shown in FIGS. 5 and 6.

Similar reference numerals refer to similar parts throughout the several Figures.

DETAILED DESCRIPTION OF THE INVENTION

Figure 1:
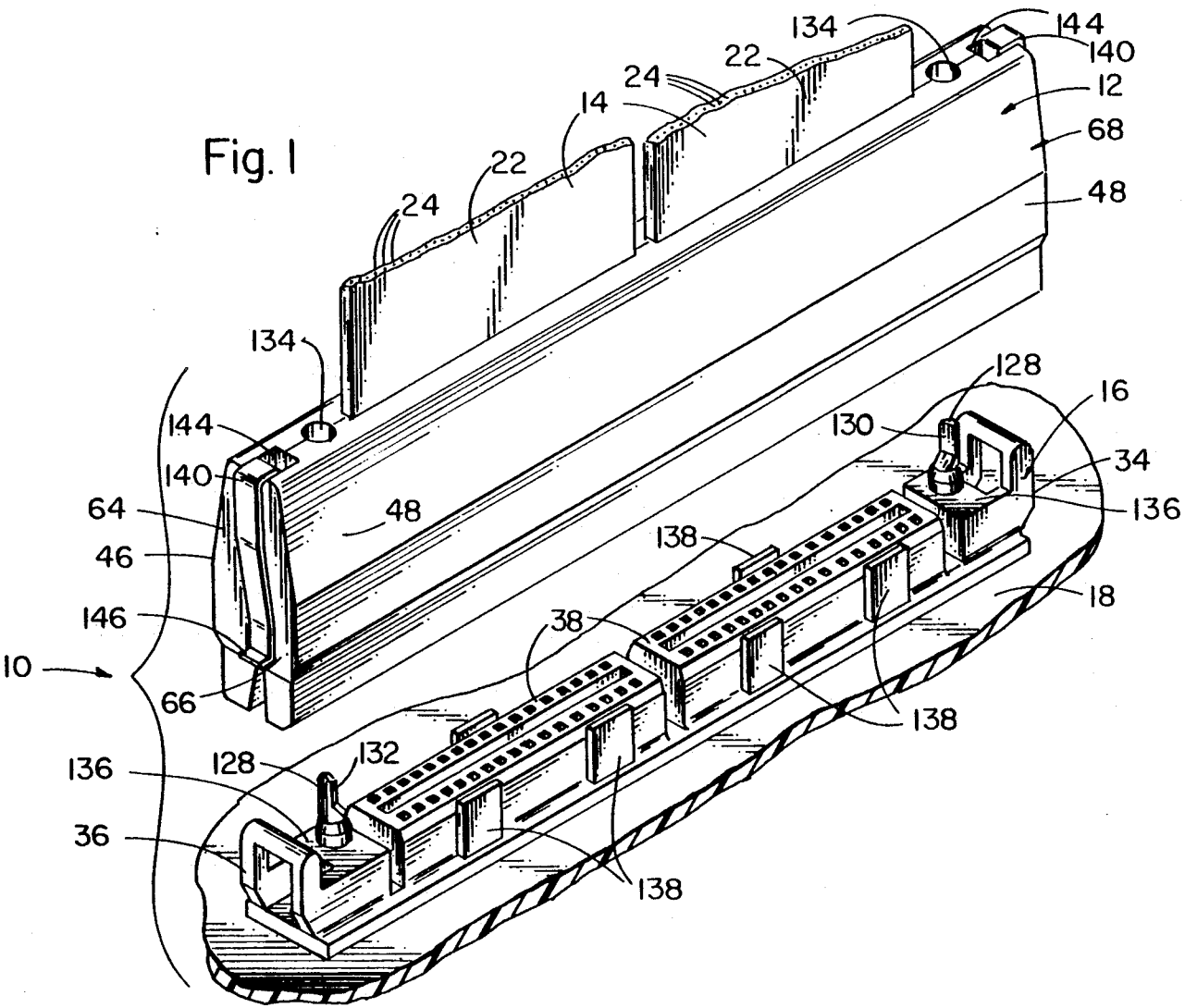
FIG. 1 is a perspective illustration of the present inventive connector supporting plural multiconductor flat cables and in a position to be coupled with an associated mating connector.

Shown in the Figures is an electrical system 10 embodying the principles of the present invention which includes a first or moveable electrical connector 12. Parts are removed or broken away in the various figures to show certain internal constructions. The movable connector 12 is shown in combination with a plurality of multiconductor flat cables 14 and with a mating second or fixed connector 16 secured to a printed circuit board 18, which together form the system 10. The multiconductor flat cables 14 are each formed as a flat member 22 fabricated of electrically insulative material having a plurality of fine, closely spaced electrical conductive wires 24 embedded therein. The wires are positioned parallel, one with respect to the other, with the insulative material of the ribbons separating the wires. The ends of the wires within the movable connector 12 are stripped for appropriate coupling with their associated contacts 26.

Figure 2:
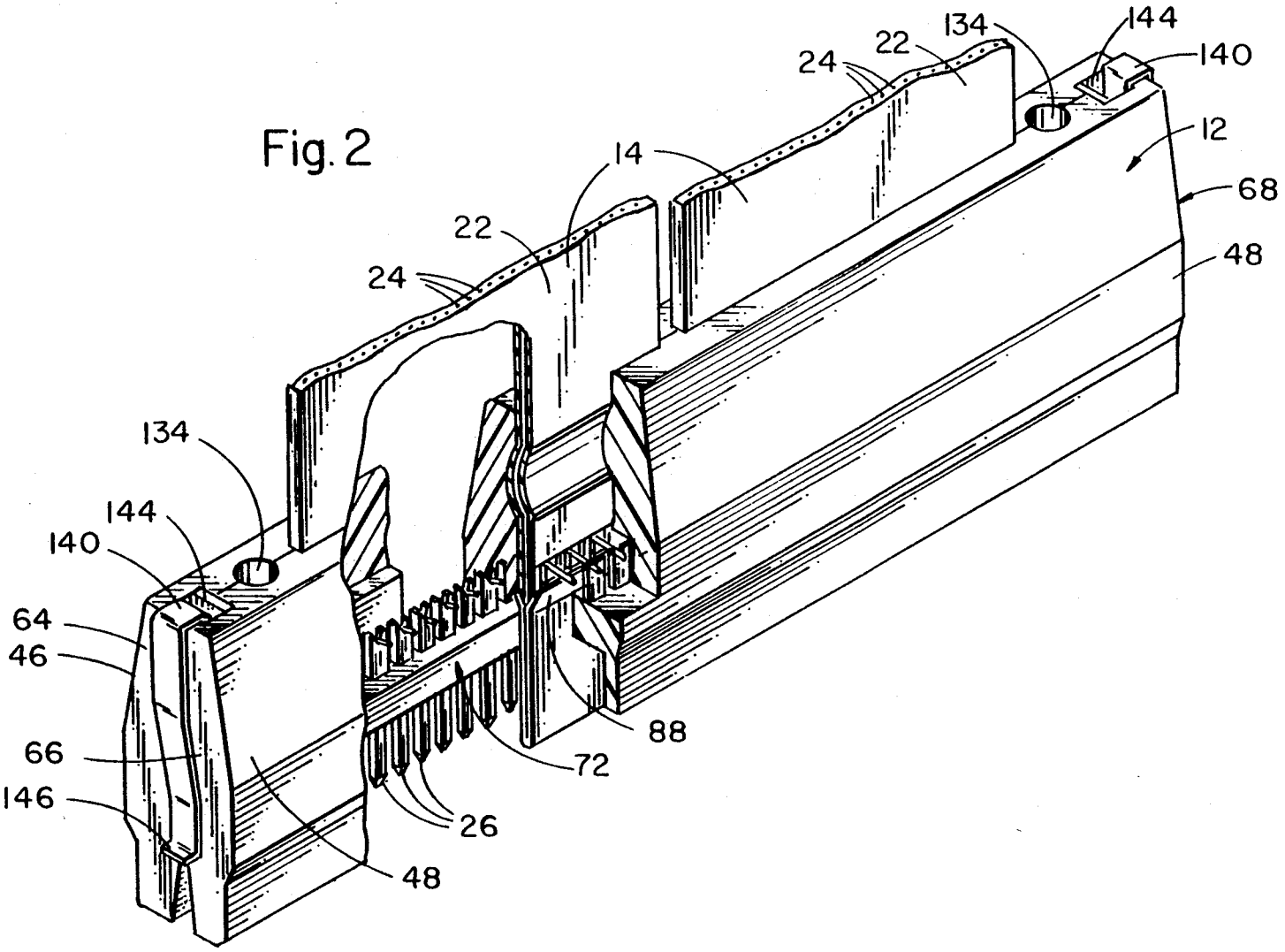
FIG. 2 is a perspective illustration of the present inventive connector as shown in FIG. 1 but with parts broken away to show certain internal constructions.

Also shown in FIGS. 1 and 2 is the printed circuit board 18. The printed circuit board supports on its upper surface, the mating second or fixed connector 16 for releasably receiving the first or moveable connector 12 whereby individual elements of the fixed connector and printed circuit board may interconnect with the individual conductive elements of the cable 14 and the movable connector 12.

The fixed connector is formed with front and rear faces 30 and 32, end faces 34 and 36, and upper and lower surfaces 38 and 40. The lower surface 40 is supported on the printed circuit board 18. Interconnecting elements are provided on the mating connector for attachment to traces on the printed circuit board. The upper surface and the front, rear and end faces of the fixed connector receive a lower surface 44 and front 46, rear 48 and end faces 50 and 52 of the movable connector 12. The fixed connector 16 also is provided with apertures 56 extending between the upper end lower surfaces. The apertures support electrically conductive receptacle connectors 58 for receiving the contacts 26 and bus 60 of the movable connector 12 to thereby conduct current between the wires of the multiconductor flat cable and the traces of the printed circuit board. The preferred material for the fixed connector 16 is Rynite polymer. Rynite is a trademark of the General Electric Company. The movable connector 12 itself is formed of a plurality of connectable component elements formed of an electrically insulative, plastic material. The preferred material for the connectable elements is Ultemp polymer. Ultemp is a trademark of the General Electric Company. These connectable component elements include the front cover half 64 and rear cover half 66 which together form the housing 68 which is adapted to secure the movable connector 12 to the printed circuit board 18. The housing 68 is also configured and adapted to support plurality of blocks 72 which, in turn, support the electrically conductive signal contacts 26 and the electrically conductive ground bus 60 for termination of the conductors in the multiconductor flat cable and for providing electrical connections with the individual electrical conductive segments of the fixed connector and the printed circuit board.

As used herein the terms front and rear, upper and lower, horizontal and vertical, and the like are used for descriptive purposes only. It should be readily appreciated that the connector of the present invention could be used in any vertical, horizontal, or angular orientation without departing from the spirit and scope of the invention. Further, when the multiconductor f at cables are received by the movable connector, the majority of its extent lies in a plane which is the longitudinal central plane of the movable connector, the fixed connector and the ground bus . The terms interior and exterior and the like are intended to be construed with respect to this longitudinal central plane. In addition, the present invention is suitable for the first connector to be movable and the second connector to be fixed as shown in the embodiments disclosed herein. As an alternate embodiment, the upper connector could be fixed and the lower connector could be movable. Lastly, it should also be understood that both connectors could be movable. The descriptive language herein should, in no way, be construed as limiting the invention in any manner.

With particular reference to FIGS. 2, 3, 5, 7, 8 and 9, each block 72 is formed of a generally rectangular member with front and rear faces 74 and 76, end faces 78 and 80, and upper surface 82 and a lower surface 44. Each block is fabricated into a unitary component member as by molding. Each block also includes a central slot or slots 86 within the longitudinal central plane of the connector of such size and shape to receive a ground contact or bus 60. A single slot is preferably utilized for receiving a twenty pin flat cable 22. A pair of slots is preferably utilized for receiving a 40 pin flat cable, with half of the ground pins in one slot and the other half of the ground pins in the other slot.

The bus is a blade-like electrically conductive member formed of an electrically conductive material, preferably metal. It is formed in a tight U-shaped configuration with its free edges 88 extending upwardly and outwardly, flared to a limited degree, for assisting in locating and receiving ground wires of the multiconductor flat cable. Specifically, those wires of the cable intermediate the signal wires are those wires which function as electrical grounds. The flare at the upper extent of the bus limits its downward movement into the slot. The lower portion of the ground bus is adapted to be received downwardly into the central slot 90 of the fixed connector 16 with its elongated bus receptacle connector 92.

Also located within each block 72 are vertical apertures 94 between the upper and lower surfaces adapted to receive and support signal contacts 26. The signal contacts are formed of an electrically conductive material, preferably metal. They include posts of a rectangular cross-sectional configuration over the majority of their lower lengths. Their upper extents are rectangular in cross-section but enlarged with respect to their lower extents for being received by, and supported upon, the upper surface of the block. Their upper edges are provided with notches, perpendicular with respect to the longitudinal central plane of the connector. Each notch has a U-shaped or semicircular lower extent for receiving a signal wire of the multiconductor flat cable, the lower stripped ends of the ground contact wires and signal contact wires of the multiconductor flat cable. The lower stripped ends of the ground contact wires and signal contact wires are thus adapted to be received, respectively, by the ground contact bus 60 and signal contacts 26. The ground bus and signed contacts are for mechanically and electrically coupling the wires of the cable with the electrically conductive receptacle connectors of the fixed connector and, hence, to the traces of the printed circuit board, all in a particular predetermined orientation.

Each block 72 is adapted to be positioned in a particular orientation in contact with the interior faces of the housing halves. To this end, each block 72 has recesses 96 and 98 on its front and rear faces. The recesses are formed one on one face and two on the opposite face. They are adapted to receive projections 102 and 104 of mating size, location and number on the interior front and rear faces of the housing halves 64 and 66 to effect rough alignment and proper orientation of the blocks to housing halves during fabrication. It is thus impossible to improperly orient the blocks within the housing halves. Note FIGS. 8 and 9. In addition to the recesses and projections, the FIG. 8 sectional view through the block and housing halves illustrates a horizontal recess 108 within the housing halves which forms upper and lower ledges 110 and 112 of such size and location to allow the blocks 72 to be received therein. This coupling is to preclude raising or lowering or other vertical movement of the blocks within the housing halves during fabrication as well as during operation and use.

In the preferred embodiment of this invention, the alignment, which can be attained using the mating of projections 102 and 104 with recesses 96 and 98, is not sufficient to provide the precise alignment necessary to maintain the impedance characteristics which are desired. The engagement of projections 102 and 104 in recesses 96 and 98 only provides only rough alignment. Precise alignment is attained by positioning each of the modular blocks 72 in a separate fixture to precisely align all of the modular blocks 72 with respect to the housing halves 64 and 66. Each modular block 72 with attached wires, adapted to be received within housing halves, may be considered to be a modular block subassembly 100.

This positioning is accomplished by adding a fixturing assembly 300 in which the ground bus 60 in each modular subassembly 100 is precisely aligned relative to the fixturing assembly. The fixturing assembly includes a fixture block 302 with aligned slots 304 for receiving a plurality of busses 60 of a plurality of modular block subassemblies 100 in accurate positions with respect to each other. Adjacent to the slots 304 are holes 306 located for receiving the signal contacts 26. Thus, a plurality of modular subassemblies can be aligned end to end with the ground bus 60 in each subassembly precisely positioned within an accurately defined slot 304 in the fixture block 302. In this manner, the positioning of the signal contacts 26 and bus contacts 60 in all of the modular assemblies is maintained in such a manner that the desired electrical characteristics can be achieved.

The fixture block 302 is secured on a support 310 as through a bolt 312 or bolts. Ultrasonic welder heads 316 are also secured to the support 310 for reciprocal movement toward and away from the connector parts to be supported and welded.

After the modular subassemblies are positioned in the fixturing subassembly 300, the housing halves 64 and 66 can be assembled therearound and held by leaf springs secured at their inboard ends to the support 310. The housing halves 64 and 66 are assembled on the precisely aligned modular subassemblies by receipt of projections 102 and 104 in recesses 96 and 98. At this point the precisely positioned modular subassemblies 100 are fixedly secured to the housing halves 64 and 66. At the same time, the housing halves 64 and 66 are held in position with respect to the block 72 by leaf springs 314 and are then ultrasonically bonded to each other. In this manner, an ultrasonically bonded assembly is established and precise alignment of the modular block subassemblies is achieved despite rough alignment with each of the blocks 72 relative to the housing halves 64 and 66. By ultrasonically bonding the insulative members together, no additional dielectric material need be added. Further, the electrical characteristics of the assembly are not altered by changes in the dielectric properties of the insulative housings.

The front and rear housing halves 64 and 66 are provided with a strain relief recess 116 and a mating strain relief projection 118 adjacent to their upper interior surfaces for receiving and holding the cable 14 to preclude its movement from the connector 12 during operation and use as might occur through inadvertent pulling.

Additional component elements of the connector are two similarly configured programmable keys 122 and 124. Programmable keys are commercially available devices. They include key halves 126 and 128 with angled faces 130 and 132 therebetween. Upper and lower halves of the keys are positioned in aligned apertures 134 and 136 adjacent to the ends of the housing halves and the fixed connector. In this manner, the moveable connector 12 can be positioned and mated with the fixed connector only when the angled surfaces of the keys are in parallel relationship, in full facing contact with each other. If the moveable connector were rotated 180 degrees in an attempt to mate the fixed and moveable connectors, the mating faces 130 and 132 of the programmable keys would not mate and coupling could not occur. The keys also preclude the coupling of one movable connector to a fixed connector with which it was not intended to couple due to the rotational orientation of its keys.

Preclusion of improper positioning of the movable connector 12 with respect to the fixed connector 16 is further effected through the use of polar tabs 138. The polar tabs are vertically oriented and are located on the front and rear faces of the fixed connector extending slightly above the upper surface thereof. Two are located on one face and one on the other face. These polar tabs mate with parallel recesses in the interior faces of the movable connector when the connectors are properly inserted, one with respect to each other.

The connection of the fixed connector 16 and movable connector 12 is effected through a pair of "S"-shaped clips 140. The clips are of a resilient spring metal such as steel with their upper ends 142 facing downwardly and received in recesses 144 at the upper ends of the connectors. Their lower ends 146 are adapted to be received in slots 148 on the lower end portions of the second or mating connector 16. Simply sliding the first connector 12 downwardly with respect to the second connector 16, with the programmable keys 122 and 124 properly aligned, will allow the lower halves of the clips 140 to reside outwardly and then attach to the fixed connector 16 for proper securement. Separation can be effected by simply moving the lower ends 146 of the clips inwardly as by a fingernail, pin, pencil point, or the like so that each end may sequentially clear the slot of the second connector. By placing the programmable keys 122 and 124 and clips 140 at the ends of the connectors, additional space on the printer circuit board is saved when compared with placing the attachment means along the entire lengths of the sides thereof.

In the normal mode of operation, every other wire 26 of the multiconductor flat cable is a ground for being received by the ground bus 60. Every intermediate wire 26 of the multiconductor flat cable 18 is adapted to carry a signal from the cable to the printed circuit board. As such, every signal wire of the cable must be bent outwardly toward an appropriate signal contact on one side or the other of the longitudinal central plane. In this manner, appropriate wires of the multiconductor flat cable may be coupled with appropriate traces of the printed circuit board for accommodating and effecting the intended electronic function of the connector.

The upper end 88 of the ground bus 60 at the flared section and slightly therebeneath, as well as the U-shaped notches of the signal contacts, are adapted to be coated with a soldering material prior to receiving their appropriate wires. In this manner, when the wires of the multiconductor flat cable are brought into contact with the appropriate sections of the ground bus and signal contacts, mechanical contact may be made. This is followed by soldering.

The block 72, with its ground bus and signal contacts as well as its connector wires of the cable in proper position, may then be heated as through radio frequency energy to liquify the solder material between the ground bus and ground wires as well as between the signal contacts and signal wires to make secure solder connections therebetween.

Figure 3:
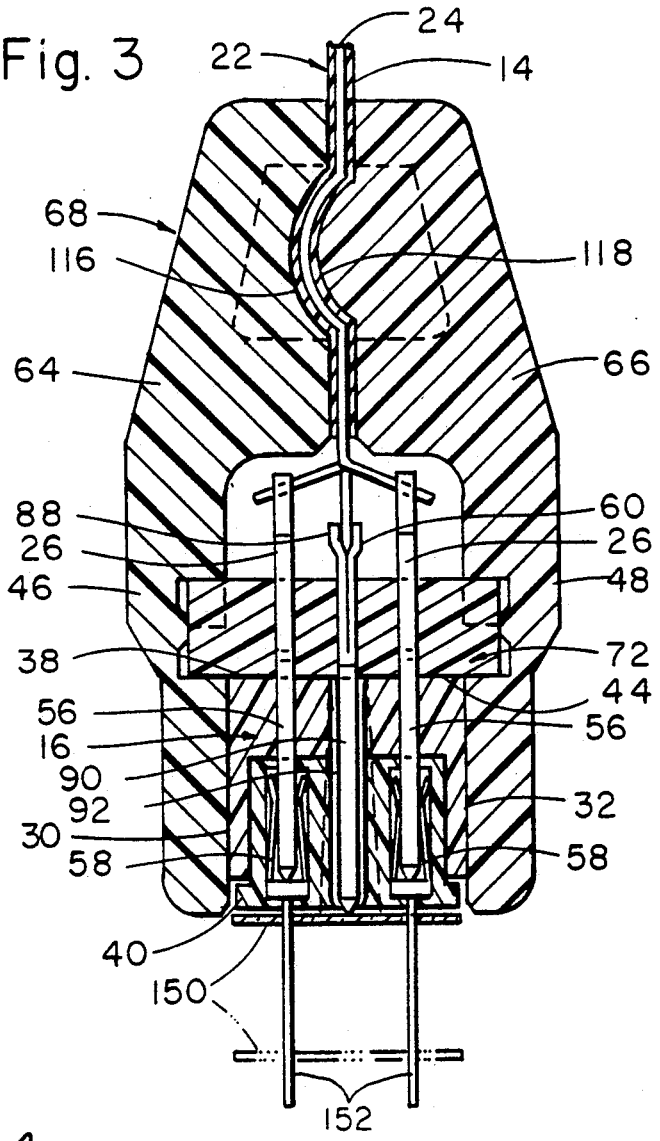
FIG. 3 is a sectional view of the connector shown in FIG. 2 taken through the center of the connector, mating connector and multiconductor flat cable.

As particularly seen in FIG. 3, the signal connector wires of the cable are bent from the vertical slightly less than a full 90 degrees. By bending them at about 70 degrees, their exterior portions remote from the bends will contact an exterior portion of the signal contacts, the edges of the signal contacts remote from the longitudinal central plane. When urged downwardly during coupling, the ends of the signal wires will be forced slightly upwardly by the signal contacts to beyond the desired 70 degrees for insuring complete contact between all of the signal wires and their signal contacts.

The deflection upwardly may be between about an additional 5 and 20 degrees, but still preferably below the horizontal or 90 degree orientation. This deflection of the wire insures a secure physical contact between each signal wire and its associated signal contact prior to soldering.

The diameter of the U-shaped slot of the signal contacts is equal to or preferably slightly greater than the diameter of the conductive signal wires and of the multiconductor flat cable. The soldering may thus effect an encapsulation of at least about 270 degrees of the wires, for forming a mechanical bond as well as an electrical coupling. In practice, the solder material will often totally encapsulate the entire cross section of the signal wires along their entire lengths. Contrary to previous thoughts, a mechanical wedging action between the wire and slot to be soldered has been found to be unnecessary, and hence the diameter of the wire is preferably not greater than the width of the slot or the diameter of its bight.

In the preferred embodiment, the solder material may be applied to the appropriate portion or portion of the ground contact and signal contacts by any one of a plurality of techniques including plating, printing, silk-screening, dipping or in laying. In the preferred embodiment, the solder material is plated onto the upper end of the ground contact and the signal contact to at least cover the U-shaped bight. The soldering may be enhanced by a commercial flux material provided onto the striped wire ends. The solder may be caused to reflow by any one of a plurality of methods of heating, including radio frequency, resistance, laser or vapor phase. Radio frequency is the preferred embodiment.

As will be understood by one skilled in the art, the coupling of the stripped wire ends to the signal contacts is effected by adhesion between the soldering material intermediate the wires and the signal contacts, the reflowing of the soldering material therebetween effecting the coupling. It should be further understood, that the desired coupling may be effected by a wide range of adhesive coupling techniques.

Figure 9:
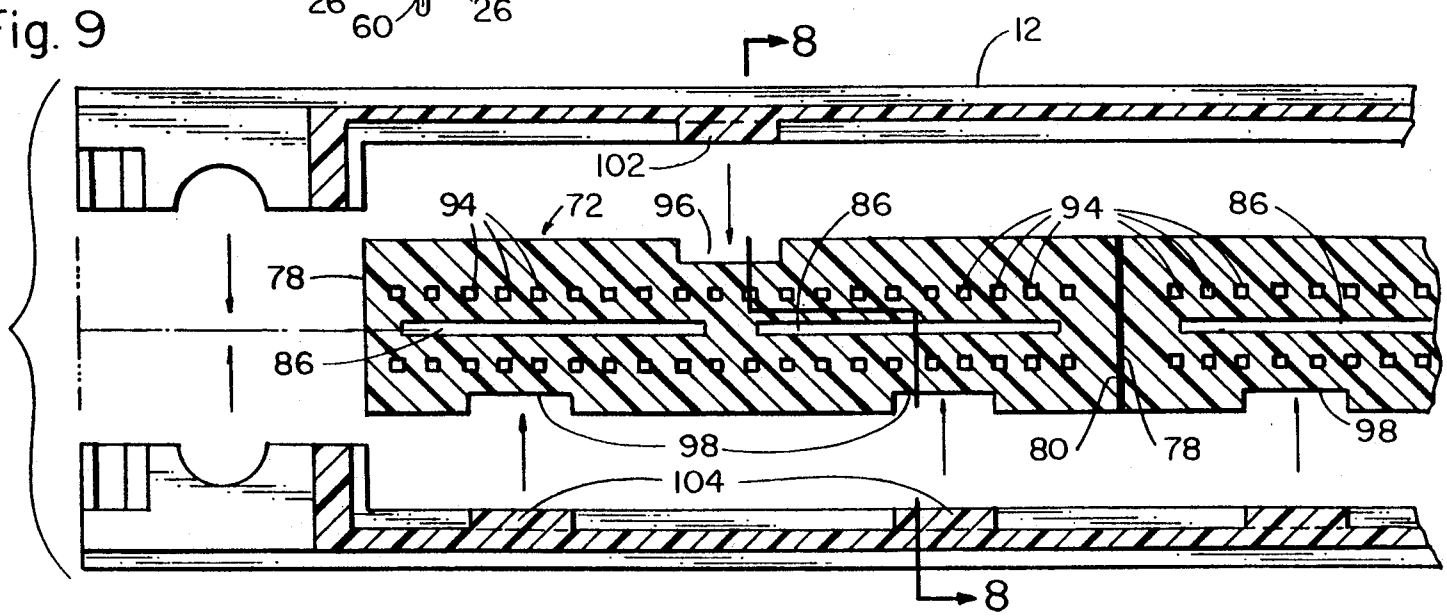
FIG. 9 is a sectional view of the connector or FIG. 8 taken along line 9—9 of FIG. 8.
Figure 10:
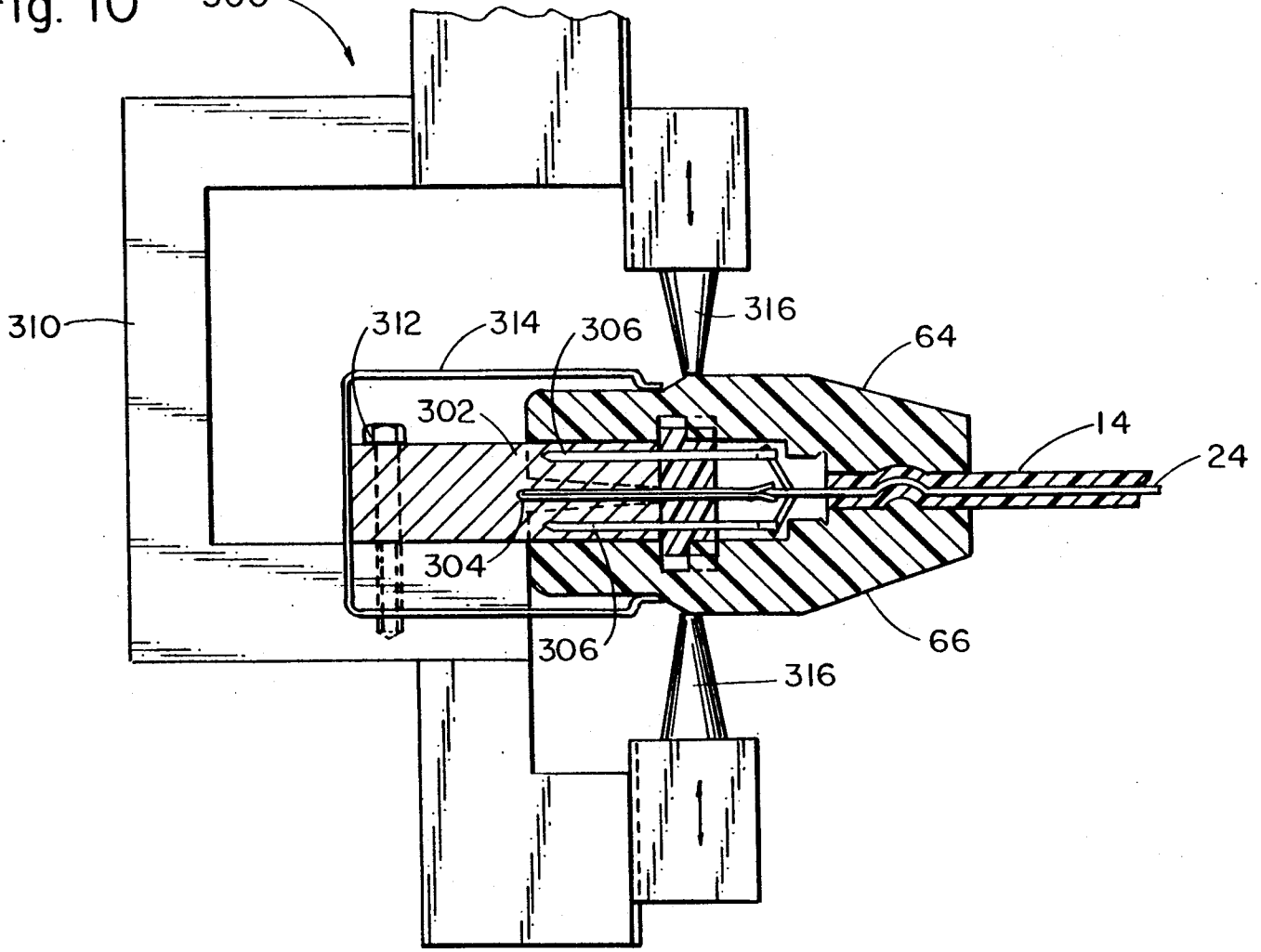
FIG. 10 is an end sectional view of apparatus to facilitate the manufacture of the connector as shown in the previous Figures.
Figure 11:
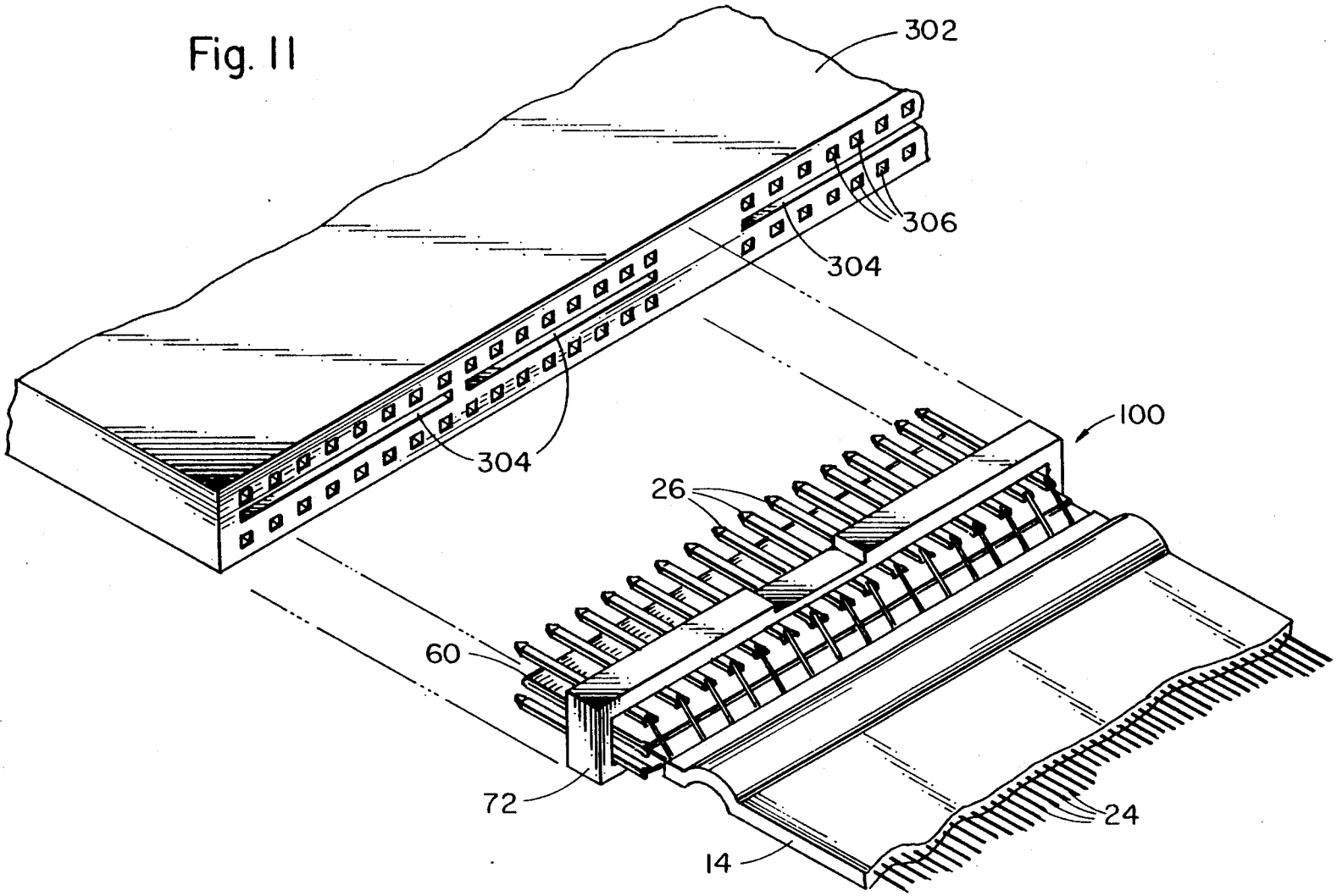
FIG. 11 is a perspective illustration of the central portion of the apparatus as shown in FIG. 10.

The attaching of the blocks 72 with respect to the housing halves 64 and 66 is effected by simply holding the cover halves parallel with each other adjacent to the blocks, on opposite sides thereof, after the stripped cable ends have been coupled to the signal contacts and the ground bus. The blocks are also held in parallel relationship with respect to each other as shown in FIGS. 7 and 9. While maintaining this parallel relationship, the halves are moved either simultaneously or sequentially toward the blocks. The housing halves and blocks with their projections, recesses and ledges will readily, mate for proper operational positioning and support of the housing halves with respect to the block. Thereafter the cover halves and blocks are ultrasonic welded at their areas of mutual contact, as are the cover halves to each other, for a secure, essentially permanent coupling. The device is now ready for mating with a fixed housing half as a final item of industrial use.

Figure 4:
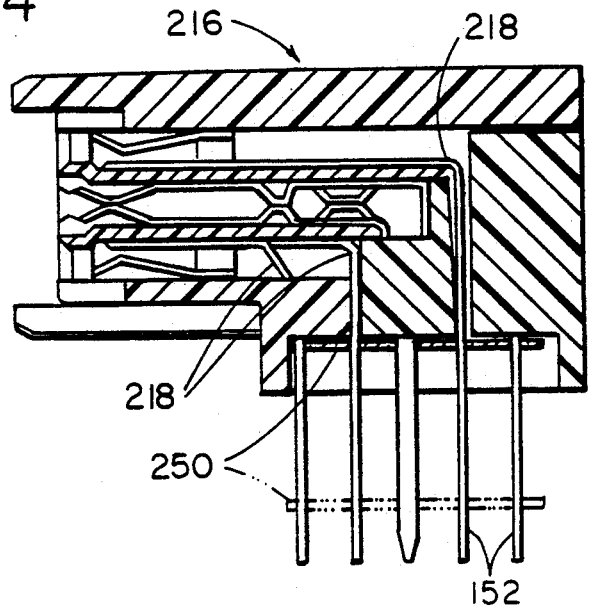
FIG. 4 is a sectional view, similar to FIG. 1 but illustrating an alternate embodiment of the mating connector.
Figure 8:
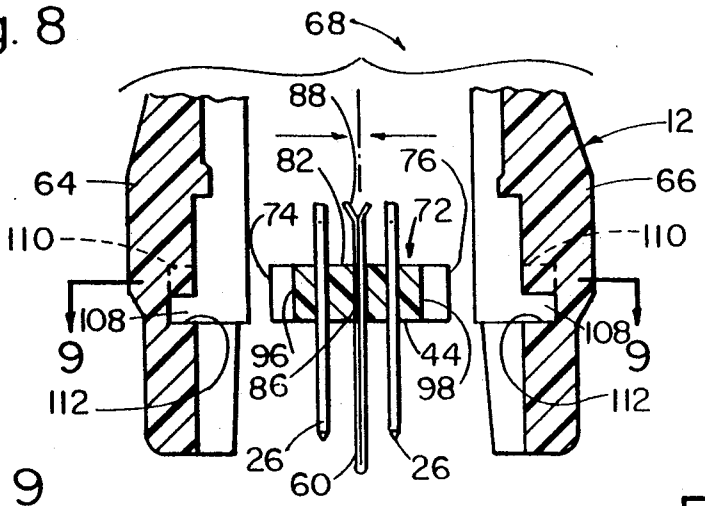
FIG. 8 is a sectional view of the connector or FIGS. 5, 6 and 7 taken along line 8—8 of FIG. 5.

Shown in FIG. 4 is an alternate embodiment of the present invention wherein the fixed connector 216 is mounted to the printed circuit board in a right angle configuration. The fixed connector is the same as that of the primary embodiment, except for its pin receiving receptacle connectors extending in alignment with the pins and then forming a bend 218 at an angle of 90 degrees with respect thereto. The solder tails 252, as in the primary embodiment, extend through the printed circuit board for being wave soldered thereto to effect the electrical connection. It should be realized in this regard, that the through-hole fixed connectors on the circuit board could readily be utilized as could the surface mount connectors wherein the receptacle connectors terminate on the near side of the printed circuit board and are soldered thereto rather than extending through the through-holes in the printed circuit board.

FIGS. 3 and 4 show a solder tail leg organizer or environmental shield 150 and 250 which are preferably used in all embodiments of the invention. Each environmental shield is a thin, relatively stiff sheet of electrically insulting material, as for example, a thermoplastic. It is of a size slightly larger than the array of tails 152 and 252 for each fixed connector. It is of a size and shape with apertures of a size and shape and positioning so that the tails may be inserted through separate holes in the shield. During the fabrication step, the shield is placed with the tails extending therethrough to a depth of about half the length of the tails. Thereafter, during fabrication, when the tails are inserted through the holes of the printed circuit board prior to permanent coupling, the shield will be slid into facing contact with the lower face of the fixed connector. In this manner, the shield constitutes an environmental barrier to preclude premature oxidation or rusting of the components within the fixed connector.

The present disclosure includes that information contained in the appended claims as well as that in the foregoing description. Although the invention has been described in its preferred forms or embodiments with a certain degree of particularity, it is understood that the present disclosure of the preferred form has been made only by way of example and that numerous changes in the details of construction, fabrication and use, including the combination and arrangement of parts and method steps, may be resorted to without departing from the spirit and scope of the invention.

What is claimed is:

1. An electrical connector for coupling the signal and ground wires of a plurality of multiconductor flat cables with another electrical component comprising, in combination:

a plurality of electrically insulating blocks;

a plurality of signal contacts extending through each block, the signal contacts of each block couplable with the signal wires of one associated multiconductor flat cable;

an elongated ground bus extending through each block, each elongated ground bus couplable with the ground wires of one associated multiconductor flat cable;

a single housing for supporting the plurality of blocks in a fixed position with respect to each other;

an additional electrical member having a plurality of receptacle connectors for receiving signal contacts, the additional electrical member also having an elongated receptacle connector for each block for receiving its ground bus; and means to couple the housing with the additional electrical member.

2. The electrical connector as set forth in claim 1 wherein the last mentioned means includes clips releasably secured to the ends of the housing.

3. The electrical connector as set forth in claim 2 wherein the clips are S-shaped with first ends receivable in recesses of the housing.

4. The electrical connectors as set forth in claim 1 wherein the housing is formed of mating housing halves with recesses for receiving the plurality of blocks.

5. The electrical connector as set forth in claim 4 wherein the blocks and housing halves are coupled together through ultrasonic welding.

6. The electrical connector as set forth in claim 4 wherein the blocks are formed with projections for being received within the recesses to insure rough lateral positioning of the blocks within the housing halves.

7. The electrical connector as set forth in claim 6 wherein the recesses and projections are different on opposite sides of the connector to preclude improper positioning and movement between the blocks and housing halves.

8. The electrical connector as set forth in claim 7 and further including ledges formed in the housing halves to receive the blocks and preclude improper positioning and movement between the blocks and housing halves.

9. An electrical connector for coupling the wires of a plurality of multiconductor flat cables with another electrical component comprising, in combination:

a plurality of electrically insulating blocks;

a plurality of signal contacts extending through each block, the signal contacts of each block couplable with the wires of one associated multiconductor flat cable;

a single housing for supporting the plurality of blocks in a fixed position with respect to each other during coupling and uncoupling with another electrical connector, the housing having means to releasable couple with another electrical connector; and orienting means at the ends of the housing adapted to mate with another electrical connector to insure proper orientation when coupling the electrical connector with the electrical connector, the orienting means being formed as a pair of posts, the one post of each pair having a surface angled with respect to an angled surface of the other post of its pair.

10. For conducting electrical current to the traces of a printed circuit board, the combination comprising:

a first connector having a plurality of electrically insulating blocks, a plurality of signal contacts extending through each block, and a single housing for supporting the plurality of blocks in a fixed end to end position with respect to each;

a plurality of multiconductor flat cables, each multiconductor flat cable being operatively associates with one of the blocks, each multiconductor flat cable having a plurality of signal wires for conduct current with each signal wire having a stripped free and coupled to an in electrical contact with one signal contact of its associated block;

a second connector couplable of a printed circuit board, the second connector having receptacle connectors for receiving the signal contacts of the first connector to thereby electrically couple the signal wires of the multiconductor flat cables with the receptacle connectors; and an elongated ground bus extending through each block and an elongated receptacle connector in the second connector means for receiving the ground bus.

11. The combination as set forth in claim 10 wherein the receptacle connectors are electrically connected to traces of a printed circuit board.

12. The combination as set forth in claim 11 wherein the receptacle connectors include elongated tails for extending through holes in a printed circuit board.

13. The combination as set forth in claim 12 wherein the receptacle connectors and their tails includes a right angle bend.

14. The combination as set forth in claim 12 and further including a flat shield with apertures receiving the tails of each receptacle connector and positioned in contact with the second connector.

15. A method of assembling an electrical connector for interconnecting a plurality of multiconductor flat cables having signal and ground conductors configured to maintain a prescribed impedance in each cable to a second electrical connector without altering the prescribed impedance, the method comprising the steps of:

positioning a plurality of modular subassemblies in a linear alignment, each having a plurality of terminals in an insulative block, to a fixturing member, the fixturing member comprising means of precisely positioning the modular subassemblies relative to each other by engaging at least one of the terminals in each modular subassembly and precisely positioning the engaged terminals relative to each other; and securing a single insulative cover means to all of the modular subassemblies by bonding each block to the insulative cover means while at least one terminal is held in the fixturing member, one of the terminals in each modular subassembly including a ground bus precisely positioned with respect to the other terminals in the modular subassembly, the fixturing block engaging the ground bus to precisely position each of the terminals in all of the modular subassemblies relative to each other.

16. The method of claim 15 wherein the blocks are ultrasonically bonded to the cover means.

17. The method of claim 16 wherein the cover means comprises two mating covers, the blocks being ultrasonically bonded to the covers and the covers being ultrasonically bonded to each other.

* * * * *

UNITED STATES PATENT AND TRADEMARK OFFICE

CERTIFICATE OF CORRECTION

PATENT NO. : 5,116,239

DATED : May 26, 1992

INVENTOR(S) : Paul P. Siwinski

It is certified that error appears in the above-indentified patent and that said Letters Patent is hereby corrected as shown below:

In claims 9, column 13, line 23 replace "component" with --connector--;

In claim 10, column 14, line 1, replace "of" with --to--.

Signed and Sealed this

Seventh Day of September, 1993

Bruce Lehman

*Attest:*

BRUCE LEHMAN

*Attesting Officer*

*Commissioner of Patents and Trademarks*